US006254381B1

(12) United States Patent
Baynham et al.

(10) Patent No.: US 6,254,381 B1
(45) Date of Patent: Jul. 3, 2001

(54) SEALED GAS BURNER ELECTRODE ASSEMBLY

(75) Inventors: James Baynham, Cleveland; Jimmy C. Roden, Chattanooga, both of TN (US)

(73) Assignee: Maytag Corporation, Newton, IA (US)

( * ) Notice: Subject to any disclaimer, the term of this patent is extended or adjusted under 35 U.S.C. 154(b) by 0 days.

(21) Appl. No.: 09/584,290

(22) Filed: May 31, 2000

(51) Int. Cl.[7] ..... F24C 3/10
(52) U.S. Cl. ..... 431/266; 126/39 E
(58) Field of Search ..... 431/263, 264, 431/266, 269; 126/39 R, 39 E, 39 BA

(56) References Cited

U.S. PATENT DOCUMENTS

| | | | |
|---|---|---|---|
| 4,810,188 | 3/1989 | Kwiatek . | |
| 4,846,671 | 7/1989 | Kwiatek . | |
| 5,002,038 | 3/1991 | Riehl . | |
| 5,040,970 | 8/1991 | Riehl . | |
| 5,083,915 | 1/1992 | Riehl . | |
| 5,085,202 | 2/1992 | Riehl . | |
| 5,133,334 | 7/1992 | Riehl . | |
| 5,149,262 | 9/1992 | Riehl . | |
| 5,152,276 | 10/1992 | Brock et al. . | |
| 5,160,255 | 11/1992 | Sigler . | |
| 5,160,256 | 11/1992 | Riehl . | |
| 5,186,158 * | 2/1993 | Ferlin | 126/39 R |
| 5,246,365 | 9/1993 | Himmel et al. . | |
| 5,266,026 | 11/1993 | Riehl . | |
| 5,328,358 | 7/1994 | Riehl . | |
| 5,364,264 | 11/1994 | Kwiatek . | |
| 5,397,234 | 3/1995 | Kwiatek . | |
| 5,443,380 | 8/1995 | Riehl . | |
| 5,468,145 | 11/1995 | Ferlin . | |
| 5,545,036 | 8/1996 | Kwiatek . | |

FOREIGN PATENT DOCUMENTS

| | | | |
|---|---|---|---|
| 2408096 * | 6/1979 | (FR) . | |
| 1365301 * | 8/1974 | (GB) . | |
| 2054113 * | 2/1981 | (GB) . | |

* cited by examiner

*Primary Examiner*—Sara Clarke
(74) *Attorney, Agent, or Firm*—Diederiks & Whitelaw PLC

(57) ABSTRACT

A gas burner assembly providing a fast and reliable spark ignition of an air/gas mixture includes a support member, mounted in a side wall aperture of the gas burner, through which an end portion of an ignition electrode extends and at least one internal flow passage for directing the mixture directly to a terminal end of the electrode at the side wall of the gas burner. The terminal end of the electrode is substantially recessed relative to the side wall at the aperture. Preferably, a plurality of annularly spaced passages are formed in the support member, with each passage being open to the electrode such that each passage is defined, at least in part, by a section of the electrode.

17 Claims, 2 Drawing Sheets

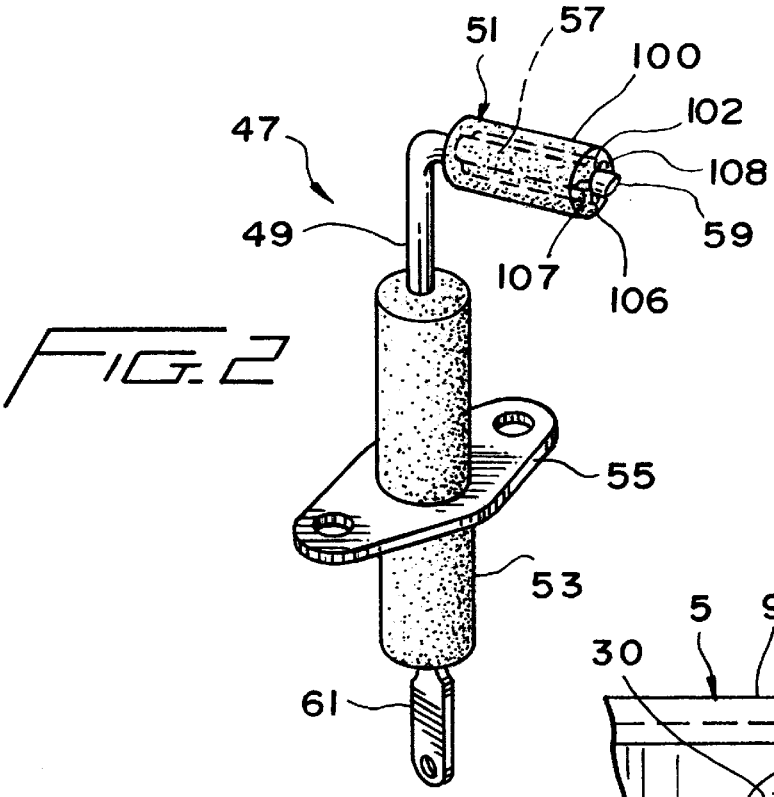
FIG. 2
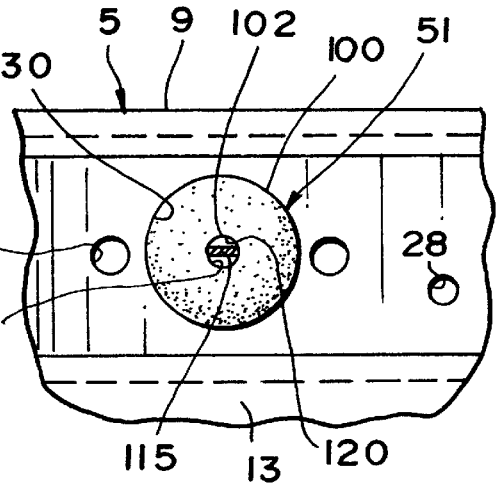
FIG. 4
FIG. 3
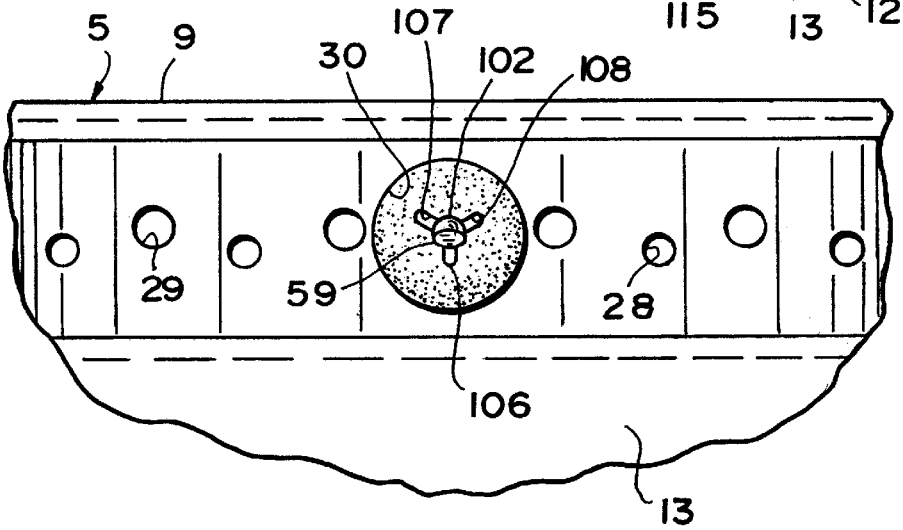

SEALED GAS BURNER ELECTRODE ASSEMBLY

BACKGROUND OF THE INVENTION

1. Field of the Invention

The present invention pertains to the art of cooking appliances and, more particularly, to a spark igniting gas burner assembly which provides for an air/gas mixture flow through an insulating support member for an ignition electrode.

2. Discussion of the Prior Art

The use of spark ignition for burners has become extremely common in gas cooking appliances. In general, spark ignition is utilized to avoid the unnecessary energy consumption required by a standing igniter pilot flame that has also been used to ignite gas range top burners. In general, it is known in the art to provide an electrically conductive gas burner including a side wall portion provided with a plurality of circumferentially spaced gas burner ports, as well as an igniter electrode having an end which terminates adjacent one of the burner ports. The electrode generally takes the form of a wire extending through the burner head, while being electrically insulated therefrom through the use of at least one insulating support member. Typically, the insulating support is sealed to the burner head such that the air/gas mixture is directed solely through the burner ports. Sending an electric current through the electrode creates a spark between the terminal end of the electrode and the burner head in order to ignite the air/gas mixture at the burner ports about the burner head.

In another known configuration, U.S. Pat. No. 4,810,188 discloses a spark ignited gas burner assembly incorporating an insulating, electrode support member formed with an elongated groove in an outer peripheral surface thereof. With this arrangement, a gas passageway is defined between the support member and a side wall of the burner, radially offset from a terminal end of the electrode. Even though varying designs have been proposed for delivering a required flow of the air/gas mixture to the terminal end of the electrode for proper ignition as discussed above, there still exists a need for an improved flow system which is not only efficient, but extremely effective, so as to assure consistent and prompt ignition.

It is also known in the art of gas cooking appliances to seal the burner assembly around an opening formed in a range top so that any spillage of food during cooking cannot pass between the burner assembly and range top. Since the terminal end of the electrode in the sealed burner assembly projects a fair distance from the side wall of the burner head, the electrode is subjected to potential damage during cleaning. Therefore, it would be desirable to recess or shorten the terminal end of an electrode to protect the electrode. However, with such an electrode mounting reconfiguration, the ignition characteristics of the overall bunner assembly is altered since the spacial relationship between the electrode and the air/gas mixture flow supplied for ignition is modified.

Based on the above, there exists a need in the art for an ignition gas flow configuration for use in connection with a gas burner assembly wherein the flow of gas directly to a terminal end of an electrode is assured, thereby guaranteeing the performance of effective and reliable ignition operations. In addition, there exists a need in the art for an improved gas burner assembly incorporating an electrode having a terminal end which is further recessed relative to a side wall of a burner head in order to protect the electrode during handling, cleaning and the like.

SUMMARY OF THE INVENTION

The present invention is directed to the mounting and configuration of an electrode assembly used in spark igniting a sealed gas buner assembly. More specifically, the gas bupper includes a head having an annular side wall provided with a plurality of burner ports and an enlarged aperture. An electrode or igniter element extends within the burner head and includes an end portion which extends through a central bore formed in an insulating support member supported by the burner head, with a terminal end of the electrode being exposed to the side wall of the burner head in a generally recessed fashion as compared to conventional sealed gas burner assemblies.

In order to assure reliable ignition, the insulating support member also defines at least one passage for directing an air/gas mixture flow through the insulating support member to the terminal end of the electrode. More specifically, the insulating support member includes an outer peripheral surface and the passage is formed within the support member at a position diametrically spaced from the outer peripheral surface. In accordance with the most preferred embodiments of the invention, multiple, annularly spaced passages are provided about the electrode. Most preferably, each of the passages opens into the bore such that an outer section of the electrode actually defines a portion of each passage.

With this arrangement, the air/gas mixture flows directly to the terminal end of the electrode when the burner is activated such that consistent and reliable ignitions are assured. In addition, by generally recessing the terminal end of the electrode, the electrode is further protected from potential damage during handling and cleaning. In any event, additional objects, features and advantages of the invention will become more readily apparent from the following detailed description of a preferred embodiment wherein like reference numerals refer to corresponding parts in the several views.

BRIEF DESCRIPTION OF THE DRAWINGS

FIG. 2 is a perspective view of an electrode incorporated in the gas burner assembly of FIG. 1;

FIG. 3 is a partial front elevational view detailing the positioning of the electrode in a side wall of the gas burner; and FIG. 4 is a partial front elevational view similar to that of FIG. 3 but depicting a partial cross-section of an electrode, constructed in accordance with a second embodiment of the invention, in the side wall of the gas burner.

DETAILED DESCRIPTION OF THE PREFERRED EMBODIMENT

Figure 1:
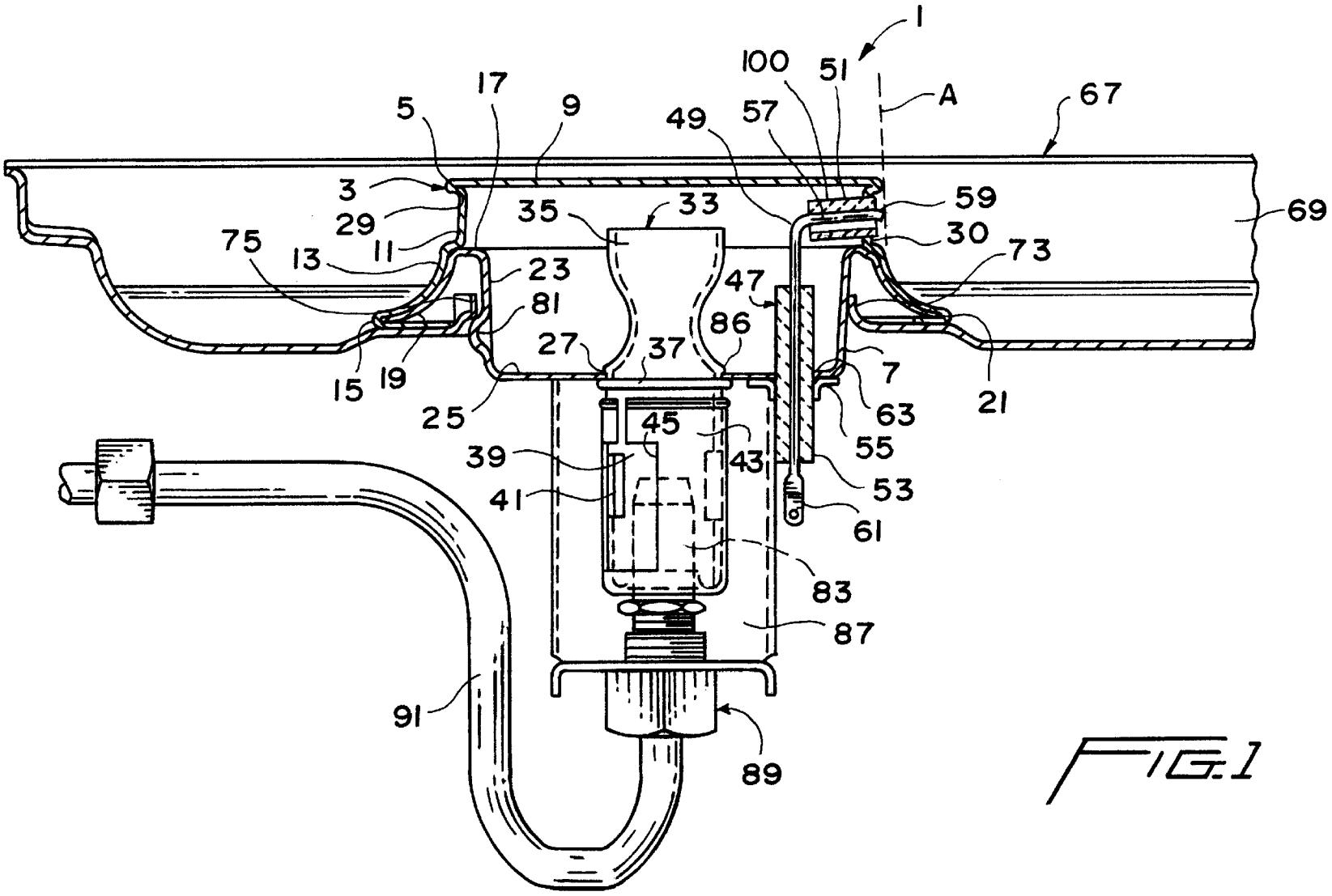
FIG. 1 is generally a cross-sectional view of a sealed gas burner assembly constructed in accordance with the present invention.

With initial reference to FIG. 1, a sealed gas burner assembly constructed in accordance with the present invention is generally indicated at 1. Burner assembly 1 includes a burner head 3 comprised of a burner cap 5 and a burner base 7. Cap 5 and base 7 are each preferably formed from drawn or stamped sheet metal. Cap 5 is of a generally circular configuration and includes a flat top 9, a vertical side wall 11 extending downwardly from top 9, and a curved side wall 13 that extends downwardly and outwardly from side wall 11. The outer circumferential edge of side wall 13 is defined by a downwardly extending circular flange 15.

Burner base 7 is also of a generally circular configuration and is defined by an upper annular rim 17 from which a curved side wall 19 extends downwardly and outwardly, and terminates in a circumferential edge 21. An inner cylindrical wall 23 extends downwardly from rim 17 and terminates in a circular bottom wall 25 which is provided with a central circular aperture 27 therethrough. The configuration of curved side wall 19 corresponds to the configuration of curved side wall 13 so that base 19 may be received within cap 5 and secured thereto by deforming flange 15 of cap 5 inwardly around edge 21 of base 7. With this arrangement, when base 7 is secured to cap 5 by crimping flange 15 around edge 21, an internal chamber of substantially cylindrical configuration is defined therebetween. Vertical side wall 11 of cap 5 is also provided with a plurality of burner ports 28, 29 (also see FIG. 3) formed therein and circumferentially spaced therearound in a manner and for a purpose to be later detailed. Side wall 11 also includes an aperture 30 for an igniter electrode, the details of which will be further described herein.

There is provided a venturi member 33 which includes a venturi tube 35, an annular ring 37 and a cylindrical tube 39 extending downwardly from ring 37. Tube 39 is provided with a pair of opposed apertures 41 and a cylindrical air shutter 43 which is rotatably and concentrically received on tube 39. Shutter 43 is also provided with a pair of corresponding opposed apertures 45 which are variably alignable with apertures 41 to provide the desired air intake for member 33. As is apparent, member 33 is assembled to burner head 3 by inserting venturi tube 35 through aperture 27 of burner base 7 until tube 35 is fully received and enclosed within the internal chamber of head 3. In this position, annular ring 37 abuts the exterior surface of bottom 25 adjacent the peripheral edge of aperture 27. Member 33 is secured to base 7 through staking or crimping in a manner to be later described.

As best shown in FIGS. 1 and 2, burner assembly 1 also includes an electrode 47 that is defined by an electrical wire 49, a first cylindrical electrically insulative support member 51 and a second cylindrical electrically insulative support member 53, the latter being secured through a mounting bracket 55 to burner base 7 as will be discussed below. Wire 49 includes one end portion 57 which terminates in an end 59, which can be straight or could be slightly turned or bent as shown, and at the other end in a terminal blade 61 of appropriate configuration for electrical connection to a conventional ignition circuit. Electrode 47 is inserted through an aperture 63 formed in bottom wall 25 of base 7 and secured thereto through bracket 55 by any means known in the art. End portion 57 of electrode 47 is inserted through electrode aperture 30 of cap 5, with end 59 terminating directly adjacent side wall 11 closely adjacent support member 51. In this assembled configuration, terminal blade 61 and a portion of second insulative member 53 extends downwardly from bracket 55, the latter being disposed against the exterior of bottom wall 25.

When burner head 3, venturi member 33 and electrode 47 are assembled in the manner described, they collectively form gas burner assembly 1 which may in turn be sealably secured to a range top 67. Top 67 includes a recessed burner well 69 provided with a burner opening that is defined by a circular vertical flange 73. In the preferred embodiment, a plurality of outwardly extending L-shaped protuberances 75 are formed in flange 73 and equally spaced therearound. Each protuberance 75 cooperates with one of a plurality of corresponding outwardly extending protuberances 81 formed in cylindrical wall 23 of burner base 7 for securing burner base 7 within burner well 69. Since this particular connection is not part of the present invention, it will not be further described in detail and it should be realized that various other attachment means could be used without departing from the spirit of the present invention. When assembly 1 is secured to top 67 is this manner, a gas inlet nozzle 83 supported in a burner box (not shown) below top 67 is received within cylindrical tube 39 of venturi member 33 for the purpose of supplying gas thereto. As also evident, venturi tube 35 of member 33 is fully contained within the internal chamber of head 3, with member 33 being securely attached to bottom wall 25 through crimping or staking, as indicated at 86. A U-shaped bracket 87 is used to support a conventional gas inlet fitting 89 receives gas from a gas line 91 which is connected to an appropriate gas source (not shown).

In general, except for the construction of support member 51, as well as the configuration and positioning of end portion 57 of electrode 47, the structure and mounting of sealed burner assembly 1 is known in the art and not considered an inventive aspect of the present invention. Instead, reference is made to the disclosures in U.S. Pat. Nos. 5,152,276 and 5,246,365 which are herein incorporated by reference. Therefore, the above discussion is generally presented for the sake of completeness. Reference will now be made to FIGS. 1–3 in describing further details of the electrode 47 and the manner in which an air/gas mixture is provided for ignition purposes.

Support member 51 has an outer peripheral surface 100 which is, preferably, annularly sealed within aperture 30. Support member 51 also includes a bore 102 extending therethrough, preferably at a diametric central portion of support member 51. In the most preferred embodiment shown, support member 51 is generally constituted by a cylindrical element. However, at this point, it should be readily understood that support member 51 can take many shapes, including rectangular, without departing from the invention and while still incorporating bore 102 diametrically spaced from outer peripheral surface 100. End portion 57 of electrode 47 projects through bore 102 and, at least partially, aperture 30. As compared with the known prior art as represented by U.S. Pat. Nos. 5,152,276 and 5,246,365, terminal end 59 of electrode 47 is substantially recessed relative to burner head 3 at the igniter aperture 30. That is, end 59 preferably terminates radially inwardly of an imaginary vertical line A extending at an outer edge (not separately labeled) of burner cap 5 as shown in FIG. 1. With this arrangement, terminal end 59 is further protected from potential damage during the cleaning of any spillage in and around burner well 69.

An important aspect of the present invention is the manner in which a combustible air/gas mixture is directed to flow from within burner head 3 to adjacent terminal end 59 of electrode 47 for ignition purposes. As shown in these figures, support member 51 is formed, in addition to bore 102, with at least one internal passage, and preferably a plurality of annularly spaced, internal passages 106–108. As shown, passages 106–108 are arranged at a position spaced diametrically inward from outer peripheral surface 100. In the most preferred form of the invention, each passage 106–108 opens into bore 102 such that end portion 57 of electrode 47 actually forms part of each passage 106–108. In any event, passages 106–108 extend along end portion 57 and are open to both the interior of burner head 3 and adjacent side wall 11. Since passages 106–108 extend along end portion 57, the air/gas mixture is assured to be delivered opposite, i.e., directly at or adjacent, terminal end 59 such that a consistent and reliable ignition operation can be performed. As best shown in FIG. 3, passages 106–108 are preferably slot-shaped in cross-section for enhancing the flow through the passages 106–108.

In accordance with the embodiment of FIG. 4, bore 102 is not provided with slots 106–108 but rather electrode 47 has a terminal end, shown in cross-section at 115, which generally takes the form of a blade in a manner corresponding to that of blade 61. Due to the configuration of bore 102 versus terminal end 115, passages 118 and 120 are formed to enable a percentage of the combustible air/gas mixture to exit burner head 3 directly adjacent terminal end 115. Therefore, passages 118 and 120 perform an analogous function to passages 106–108, but are created simply due to a geometrical variance between bore 102 and terminal end 115. Although not shown in FIG. 4, terminal end 115 would be recessed and even preferably angled in a manner corresponding to that discussed above with respect to terminal end 59.

Although described with reference to a preferred embodiment of the invention, it should be readily apparent that various changes and/or modifications can be made to the invention without departing from the spirit thereof For instance, although terminal end 115 is shown to be generally rectangular in cross-section, other geometric shapes could be utilized to create from one to many flow passages about wire 49. Similarly, bore 102 could be equally reconfigured. In any event, the invention is only intended to be limited by the scope of the following claims.

We claim:

1. A gas burner assembly comprising:

a burner head including a side wall provided with a plurality of circumferentially spaced burner ports and an enlarged igniter aperture, said burner head being adapted to contain a combustible air/gas mixture therein with the combustible mixture being directed to flow through the plurality of burner ports;

an electrode extending within the burner head and including an end portion projecting, at least partially, through the igniter aperture; and an electrical insulator including an outer peripheral surface and a bore formed diametrically inward of the outer peripheral surface, said end portion of said electrode being positioned in the bore with said insulator being located between the burner head and the electrode at the igniter aperture, said insulator further defining at least one passage extending therethrough at a position spaced diametrically inward from the outer peripheral surface, wherein the at least one passage opens into the bore and extends along said electrode and wherein a percentage of the combustible mixture is adapted to be delivered, without substantial obstruction, from within the burner head through the at least one passage of the insulator while exiting the insulator adjacent the end portion of the electrode such that a spark created at the end portion of the electrode will ignite the percentage of the combustible mixture.

2. The gas burner assembly according to claim 1, wherein the outer peripheral surface of the insulator is annularly sealed to the burner head at the igniter aperture.

3. The gas burner assembly according to claim 2, wherein the end portion of said electrode includes a bent terminal portion, said at least one passage opening opposite the bent terminal portion.

4. The gas burner assembly according to claim 1, wherein said at least one passage includes a plurality of passages spaced about the electrode.

5. The gas burner assembly according to claim 4, wherein each of the plurality of passages in generally slot-shaped in cross-section.

6. A gas burner assembly comprising:

a burner head including a side wall provided with a plurality of circumferentially spaced burner ports and an enlarged igniter apertures said burner head being adapted to contain a combustible air/gas mixture therein with the combustible mixture being directed to flow through the plurality of burner ports;

an electrode extending within the burner head and including an end portion projecting, at least partially, through the igniter aperture; and an electrical insulator including an outer peripheral surface and a bore formed diametrically inward of the outer peripheral surface, said end portion of said electrode being positioned in the bore with said insulator being located between the burner head and the electrode at the igniter aperture, said insulator farther defining at least one passage extending therethrough at a position spaced diametrically inward from the outer peripheral surface, wherein the at least one passage opens into the bore and extends along said electrode and wherein a percentage of the combustible mixture is adapted to be delivered from within the burner head through the at least one passage of the insulator while exiting the insulator adjacent the end portion of the electrode, wherein the end portion of said electrode includes a bent terminal portion, said at least one passage opening opposite the bent terminal portion.

7. The gas burner assembly according to claim 6, wherein the end portion of the electrode is recessed relative to the burner head at the igniter aperture.

8. A sealed gas burner assembly comprising an electrically conductive burner cap having a side wall provided with a plurality of burner ports and an enlarged aperture, means for supplying a primary combustible mixture to the burner ports, an electrically insulative support member mounted in the aperture and provided with an electrode passageway, and a spark electrode extending through the passageway and being completely surrounded by the support member, with the spark electrode including a bent terminal end disposed exteriorly of the support member, said support member including an outer peripheral surface and defining at least one passage extending therethrough at a position diametrically spaced from the outer peripheral surface, wherein a percentage of the combustible mixture is adapted to flow through the at least one passage and exit the support member opposite the bent terminal end of the spark electrode.

9. The sealed gas burner assembly according to claim 8, wherein the outer peripheral surface of the support member is annularly sealed to the side wall of the burner cap.

10. The sealed gas burner assembly according to claim 8, wherein said passage extends along the spark electrode.

11. The sealed gas burner assembly according to claim 10, wherein said at least one passage opens into the electrode passageway, with the electrode defining a portion of the at least one passage.

12. The gas burner assembly according to claim 11, wherein said at least of passage includes a plurality of passages annularly spaced about the spark electrode.

13. The gas burner assembly according to claim 12, wherein each of the plurality of passages in generally slot-shaped in cross-section.

14. The gas burner assembly according to claim 8, wherein the end portion of the electrode is recessed relative to the burner head at the igniter aperture.

15. A method of igniting a gas burner assembly, including a burner head having a side wall formed with a plurality of spaced burner ports and an igniter aperture, a support member, positioned in the igniter aperture, having an outer peripheral surface and a bore, and an electrode extending through the bore and having an end terminating adjacent the side wall, comprising:

creating an internal passage in the support member such that the internal passage extends directly alone a portion of the electrode;

directing a combustible air/gas mixture through the internal passage formed in the support member diametrically inward of the outer peripheral surface, with the mixture exiting the support member adjacent the end of the electrode; and energizing the electrode to create a spark at the end in order to ignite the combustible air/gas mixture at the side wall of the burner head.

16. The method according to claim 15, further comprising: forming the support member with a plurality of internal passages which are spaced about the portion of the electrode.

17. The method according to claim 15, further comprising: recessing the end of the electrode relative to the burner head at the igniter aperture.

* * * * *